United States Patent [19]

Walter et al.

[11] Patent Number: 5,031,414

[45] Date of Patent: Jul. 16, 1991

[54] APPARATUS FOR EVACUATING FLOWABLE MEDIA FROM DISCARDED REFRIGERATORS AND THE LIKE

[75] Inventors: Hans-Peter Walter; Alfred Walter, both of Mettlach, Fed. Rep. of Germany

[73] Assignee: Walter GmbH, Mettlach, Fed. Rep. of Germany

[21] Appl. No.: 487,029

[22] Filed: Feb. 28, 1990

[30] Foreign Application Priority Data

Mar. 4, 1989 [DE] Fed. Rep. of Germany ... 8902602[U]

[51] Int. Cl.[5] ..... F25D 19/00

[52] U.S. Cl. ..... 62/298; 62/149; 62/292; 62/302

[58] Field of Search ..... 62/77, 149, 448, 239, 62/292, 298, 302, 303

[56] References Cited

U.S. PATENT DOCUMENTS 4,624,112 11/1986 Proctor ..... 62/149

4,939,905 7/1990 Manz ..... 62/149

*Primary Examiner*—Henry A. Bennet

*Assistant Examiner*—John Sollecito

*Attorney, Agent, or Firm*—Peter K. Kontler

[57] ABSTRACT

Discarded refrigerators, freezers and like cooling units are relieved of confined supplies of coolant and/or lubricant by transporting them onto a tiltable platform which attracts the cooling units by suction and tilts them until the freshly tapped portion of the normally closed circuit for coolant or lubricant is located at the lowermost point of the circuit. The lubricant or coolant can be evacuated by a pump by way of a conduit which is connected to a tapping tool and discharges into a vessel. Alternatively, the coolant or lubricant is caused to flow from the tapped circuit by gravity to gather in a vessel beneath the tiltable platform. The transporting system for cooling units can employ trolleys and winches with suction cups which lift discarded cooling units from the gathering point for discarded cooling units and remove cooling units from the platform when the lubricant- or coolant-evacuating operation is completed. Several apparatus can be mounted in a common vehicle for transport to and from the locale which is selected for manipulation of discarded cooling units.

14 Claims, 4 Drawing Sheets

APPARATUS FOR EVACUATING FLOWABLE MEDIA FROM DISCARDED REFRIGERATORS AND THE LIKE

BACKGROUND OF THE INVENTION

The invention relates to improvements in apparatus for manipulating discarded cooling units, such as freezers and refrigerators. More particularly, the invention relates to improvements in apparatus for evacuating flowable media from discarded cooling units.

The means for cooling foodstuffs and/or other commodities in a freezer or refrigerator normally comprises a closed circuit for a supply of coolant. In many instances, the coolant contains chlorofluorohydrocarbons which can adversely affect the environment if permitted to escape into the atmosphere. Such constituents of coolants which are used in many cooling units are believed to destroy the ozone layer in the atmosphere. This is the reason that many countries prescribe controlled evacuation and disposal of volatile constituents of coolants which are confined in discarded cooling units. For example, a refrigerator which is ready to be discarded can contain up to 200 grams of chlorofluorohydrocarbons as well as up to 300 grams of lubricant. The two flowable media are confined in discrete circuits and each such flowable medium should be collected and disposed of in a controlled manner to prevent escape of volatile ingredients into the atmosphere and/or the escape of liquid constituents into the ground.

OBJECTS OF THE INVENTION

An object of the invention is to provide an apparatus which can manipulate discarded cooling units in a time-saving manner and in a fully or partly automatic way.

Another object of the invention is to provide an apparatus which can rapidly evacuate all or practically all flowable media from discarded cooling units.

A further object of the invention is to provide the apparatus with novel and improved means for collecting evacuated flowable media.

An additional object of the invention is to provide a novel and improved support for cooling units during evacuation of flowable media from their circuits.

Still another object of the invention is to provide an apparatus which can be used for evacuation of lubricants and/or coolants from discarded cooling units.

A further object of the invention is to provide the apparatus with novel and improved means for transporting discarded cooling units to and from the locus or loci of evacuation of flowable media.

Another object of the invention is to provide a novel and improved method of manipulating discarded cooling units, such as freezers and refrigerators.

An additional object of the invention is to provide an apparatus which can manipulate cooling units of all sizes and shapes and which can be readily transported to the locale or locales of accumulation of discarded cooling units which await treatment prior to scrapping.

SUMMARY OF THE INVENTION

The invention is embodied in an apparatus for evacuating flowable media (such as coolants and/or lubricants) which are confined in discarded cooling units (e.g., in refrigerators, freezers and the like). The improved apparatus comprises a support, means for changing the inclination of the support, means for transporting cooling units onto and off the support, means for tapping cooling units in order to permit evacuation of flowable medium from the cooling unit on the support, and means for collecting flowable medium which issues from the cooling unit on the support. The support preferably includes a platform having means for releasably holding discrete cooling units thereon, and the inclination changing means preferably comprises a carrier, at least one universal joint tiltably connecting the platform to the carrier and means for tilting the platform with reference to its carrier. The holding means can comprise means for attracting cooling units to the platform by suction, and the carrier can comprise an upright column. The at least one universal joint then connects the platform to the column, and the tilting means can comprise one or more fluid-operated motors, e.g., one or more pneumatic or hydraulic cylinder and piston units.

The transporting means can comprise a first conveyor having means for delivering cooling units onto the support, and a second conveyor having means for removing cooling units from the support. Each conveyor can comprise a substantially horizontal track at a level above the support, a trolley which is movable along the respective track, an engaging member having means for attracting cooling units by suction, and means for substantially vertically movably mounting the engaging member on the respective trolley. The track of one of the conveyors is or can be aligned with the track of the other conveyor.

The tapping means can include means for making holes in cooling units and conduit means for connecting the hole making means with the collecting means. Alternatively, the collecting means can comprise at least one vessel serving to gather the flowable medium issuing from the tapped cooling unit on the support in at least one selected position of inclination of the support. Such vessel or vessels are disposed beneath the support.

The apparatus can comprise at least one additional support, means for changing the inclination of the additional support, means for transporting cooling units onto and off the additional support, means for tapping cooling units to permit evacuation of flowable medium from the cooling unit on the additional support, and means for collecting flowable medium which issues from the cooling unit on the additional support. A common conveyance can be provided for the support or supports, for the inclination changing means, for the transporting means, for the tapping means and for the collecting means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
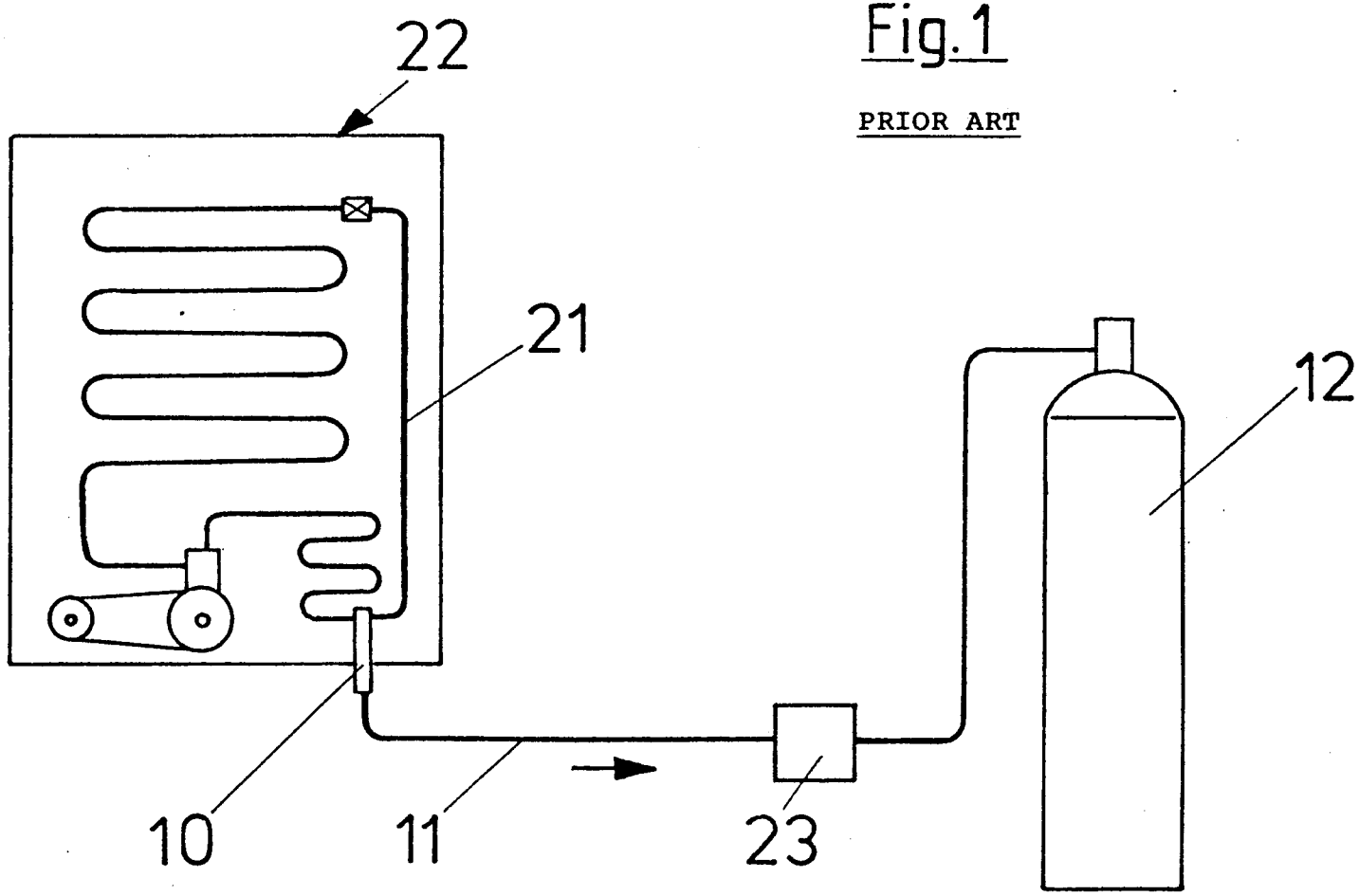
Fig.1 PRIOR ART
FIG. 1 is a schematic view of a conventional apparatus for evacuating flowable media from discarded cooling units.

FIG. 1 shows a cooling unit 22 (e.g., a refrigerator) with a closed circuit 21 for circulation of a flowable medium, particularly coolant. The reference character 10 denotes a tapping tool (e.g., suitable pliers or tongs serving to make in the circuit 21 at least one hole which permits evacuation of flowable medium by way of a conduit 11. The conduit 11 contains a pump 23 and its discharge end is connected to a collecting vessel 12 for storage of evacuated flowable medium. The tapping tool 10 can be of the type disclosed in German patent application No. 39 00 380.9-13.

The tool 10 or another tool can be used to tap the lubricant-confining circuit of the cooling unit 22 for evacuation of lubricant into another collecting vessel. The parts 10, 11, 12 and 23 together constitute a conventional apparatus for evacuation of flowable media from discarded refrigerators, freezers and/or other cooling units.

FIGS. 2 to 5 illustrate all such details of two novel apparatus 1 and 101 which are necessary for full understanding of the invention. The illustrated apparatus together constitute a mobile unit which is mounted in or on a conveyance 50, such as a van or truck, having ground-contacting wheels 51, a driver's cabin 52 as well a an engine (not specifically shown) and all other components of a motor vehicle. For example, the apparatus 1 can be used to evacuate coolant from the closed circuits of discarded cooling units 22, and the apparatus 101 can be used to evacuate lubricant from the closed lubricating circuits of discarded cooling units 22. However, it is equally possible to employ each of the apparatus 1, 101 first to evacuate the coolant and to thereupon evacuate lubricant from one and the same cooling unit 22.

Figure 2:
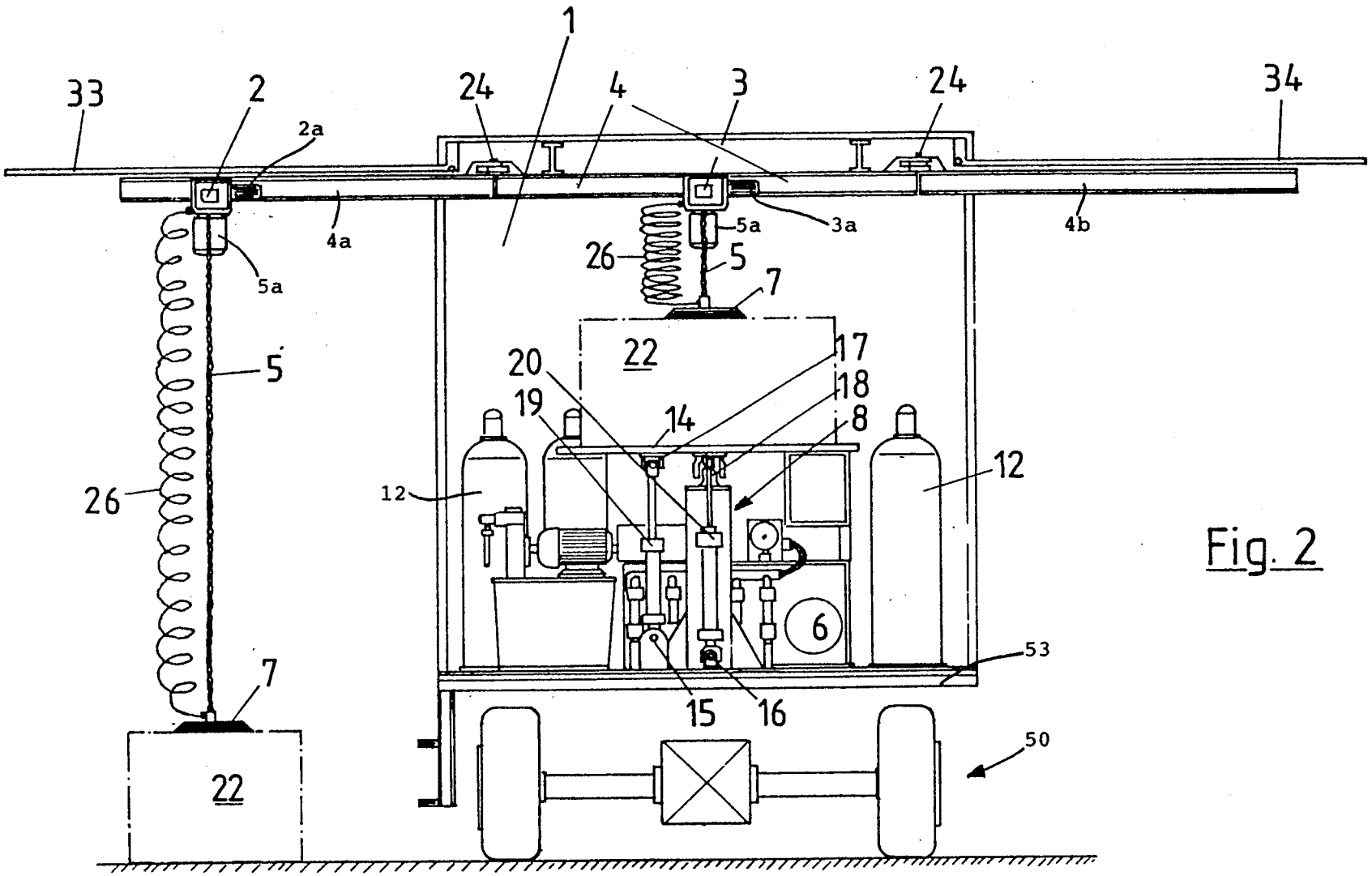
FIG. 2 is a schematic transverse vertical sectional view substantially as seen in the direction of arrows from the line II—II of FIG. 3 and shows one of two identical or similar apparatus which are installed in a wheel-mounted conveyance.

As shown in FIG. 2, the cooling unit 1 comprises a support 14 in the form of a platform which is tiltably mounted on a carrier 8 in the form of an upright column. Four universal joints 15, 16, 17 and 18 serve to tiltably connect the platform 14 to the top of the column 8 as well as to the floor 53 of the conveyance 50, and the means for tilting the platform 14 to any one of a practically infinite number of different positions includes two fluid-operated motors 19, 20 each of which can constitute a hydraulic cylinder and piston unit operable from the driver∝s cabin 52 or from a control panel (not shown) above the floor 53.

It goes without saying that the conveyance 50 can carry a single apparatus 1 or 101, or three or more apparatus which operate in parallel. Furthermore, the apparatus 1 or 101 can be mounted on the ground or on the floor in a plant, in a laboratory or elsewhere, i.e., the conveyance 50 is an optional component of the improved system.

The transporting system of the apparatus 1 comprises two discrete conveyors one of which serves to deliver discarded cooling units 22 onto the platform 14 and the other of which serves to move discarded and evacuated cooling units 22 off the platform 14. However, it is equally possible to employ a single conveyor which can perform the task of delivering discrete cooling units 22 onto as well as the task of removing discrete cooling units from the platform 14. The utilization of a transporting system with two conveyors is preferred at this time because one of the conveyors can be operated to engage and hold a discarded cooling unit 22 in a state of readiness while the other conveyor engages and/or already conveys an evacuated cooling unit 22 off the platform 14.

The left-hand conveyor of FIG. 2 comprises a substantially horizontal track including an elongated rail 4, 4*a* at a level above the platform 14 of the apparatus 1, a trolley 2 which is movable along the track 4, 4*a* by its own motor 2*a*, an engaging member 7 which has one or more suction cups (not specifically shown) serving to attract a discarded cooling unit 22, a cable or chain 5 forming part of a winch 5*a* which serves to vertically movably mount the engaging member 7 on the trolley 2, and a conduit 26 (e.g., a flexible hose) which serves to connect the suction cup or suction cups of the engaging member 7 with a suction generating device 6 in the conveyance 50.

The other conveyor of the transporting unit forming part of the apparatus 1 comprises a track which is disposed at a level above the platform 14 and includes a portion of the aforementioned rail 4 as well as an additional rail 4*b*. This track supports and guides a second trolley 3 having its own motor 3*a* and serving to transport an engaging member 7 which is or can be identical with the engaging member 7 of the first conveyor including the trolley 2. The engaging member 7 of the second conveyor is vertically movably connected with the trolley 3 by a cable or chain 5 forming part of a winch 5*a*, and the suction cup or suction cups of the engaging member 7 are connected to the suction generating device 6 (or to a discrete suction generating device) by a flexible conduit or hose 26. The track of the first conveyor is aligned with the track of the second conveyor. The rails 4*a* and 4*b* are pivotable about vertical axes defined by two pivot members 24 in the interior of the housing of the conveyance 50 and can be pivoted to the extended positions of FIG. 2 in response or subsequent to pivoting of the respective sidewalls 33, 34 of the housing to the illustrated open or lifted positions.

Figure 3:
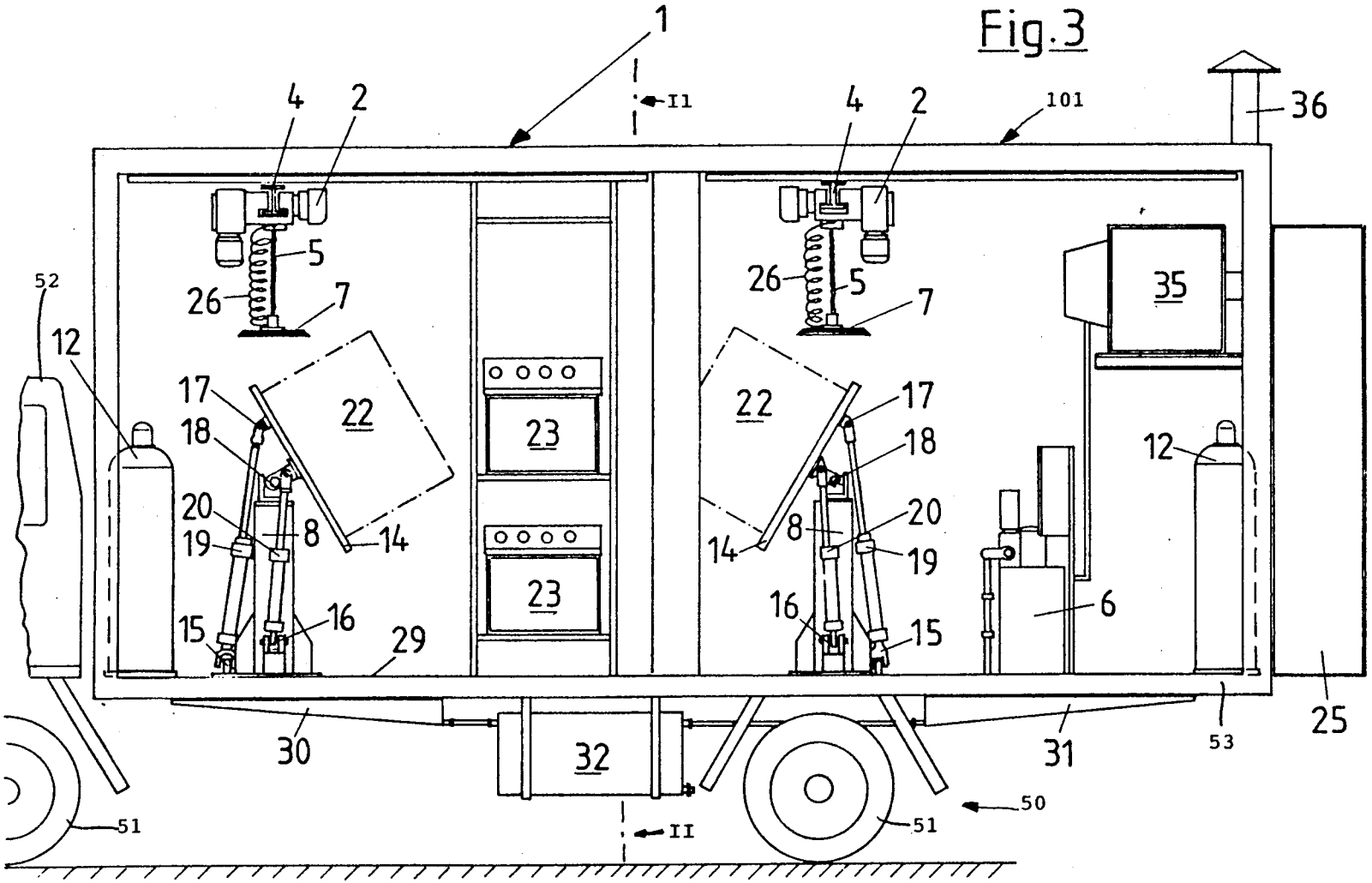
FIG. 3 is a fragmentary side elevational view of the conveyance and of the two apparatus as seen from the left-hand side of FIG. 2.
Figure 5:
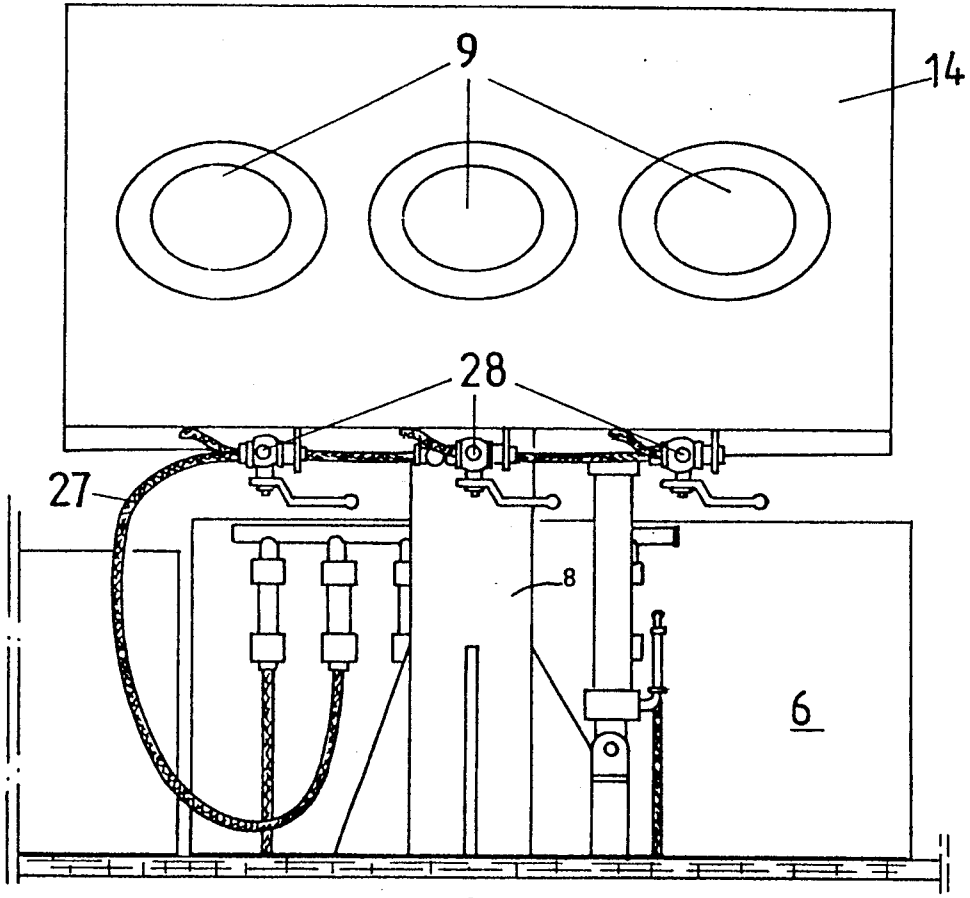
FIG. 5 is a view as seen from the left-hand side of FIG. 4 but with the cooling unit omitted.
Figure 4:
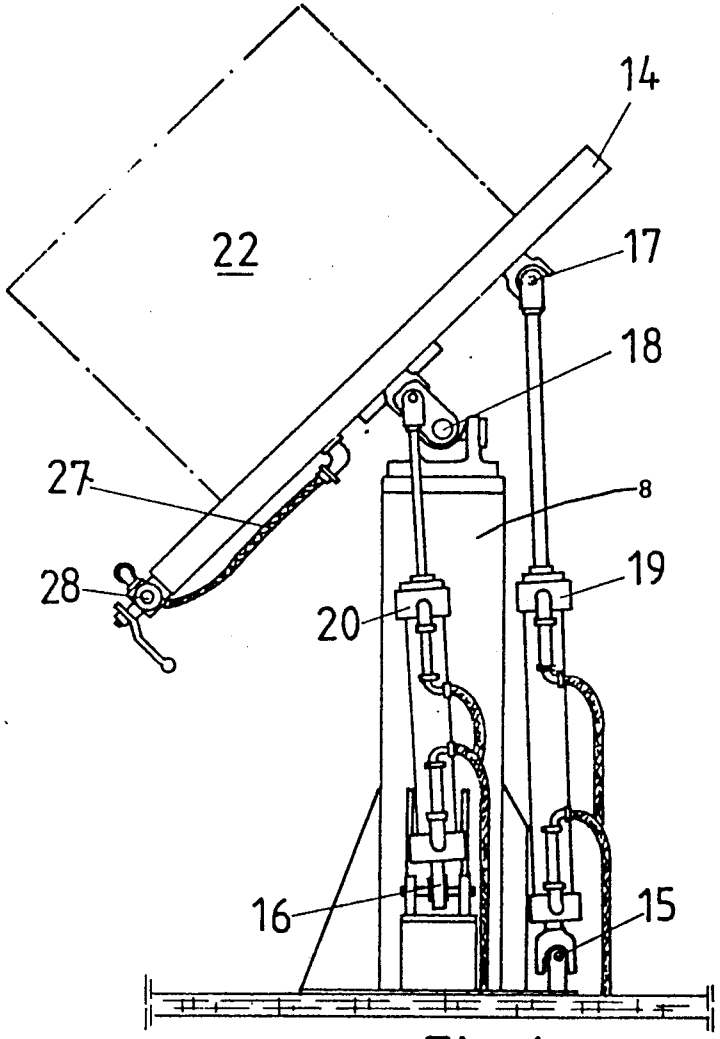
FIG. 4 is an enlarged view of the platform in one of the apparatus and of the means for tilting the platform.

FIGS. 4 and 5 show the platform 14 of the apparatus 1 in a position of pronounced inclination with reference to a horizontal plane. FIG. 5 further shows that the upper side of the platform 14 is provided with three suction cups 9 serving to releasably hold a cooling unit 22 on the platform 14 irrespective of the selected position of inclination of the platform and being connected to the suction generating device 6 by one or more vacuum lines 27. This ensures that, once the cooling or lubricating circuit of the cooling unit 22 on the platform 14 is tapped, the flowable medium can escape from the circuit in response to tilting of the platform 14 to a proper position in which the hole made by the tapping tool 10 or an equivalent tapping tool is located at, or at least close to, the lowermost point of the circuit. The tapping tool 10 can be connected with a collecting vessel 12 in the conveyance 50 (two such vessels can be seen in FIG. 2) or the liberated flowable medium is simply permitted to descend by gravity flow, to pass through a grating 29 (FIG. 3) in the floor 53 and to enter a collecting vessel 32 by way of a suitably inclined channel or duct 30 (apparatus 1) or 31 (apparatus 101).

The motors 19, 20 can be operated to tilt the respective platform 14 to any one of various inclined positions, and the universal joints 15 to 18 permit such tilting of the platform 14 in response to appropriate shortening or lengthening of the motor 19 and/or 20. The vacuum lines 27 contain valves 28 which can be manipulated by hand or by remote control in order to ensure that the suction cups 9 reliably attract a cooling unit 22 to the platform 14 during evacuation of flowable medium from such cooling unit, and that the cooling unit is released when its upper side is properly attracted by the suction cup or suction cups of the engaging member 7 of the second conveyor including the trolley 3.

The conveyance 50 further contains a heating unit 35 with a retractible chimney 36. The unit 35 is put to use on cool days when the temperature outside of the housing of the conveyance 50 is too low to permit complete evacuation of a coolant or lubricant without appropriate heating of the cooling unit on the platform 14. Detachable panels (not shown) of canvas or the like can be used on cool days to close the openings beneath the lifted sidewalls 33, 34 in order to prevent unimpeded flow of cool air into the housing.

FIG. 3 further shows a generator 25 or another suitable energy source which is mounted at the exterior of the rear wall of the housing of the conveyance 50. Such energy source is connected with the motors *2a*, *3a* and, if necessary, to other prime movers of the apparatus 1 and 101. The latter is or can be identical with the apparatus 1. If desired, the generator 25 and/or another energy source is mounted on a trailer which can be hitched to the conveyance 50.

An important advantage of the improved apparatus is that discarded cooling units 22 can be manipulated in a time-saving manner and by remote control. Furthermore, the tiltable platform 14 of each apparatus renders it possible to reliably evacuate entire supplies of coolant or lubricant from the cooling units 22 on the platform 14. All that is necessary is to tilt the platform 14 to a position in which the hole made by the tapping tool 10 or by another suitable tool is located at or close to the lowermost point of the respective coolant- or lubricant-confining circuit. The collected flowable medium can be disposed of at an authorized site or is delivered to a regenerating plant for processing prior to renewed use in a cooling unit.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art and, therefore, such adaptations should and are intended to be comprehended within the meaning and range of equivalence of the appended claims.

What is claimed is:

1. Apparatus for evacuating flowable media, which are confined in successive cooling units, comprising a support; means for changing the inclination of said support; means for transporting successive cooling units onto and off said support so that each cooling unit which has been transported to said support is temporarily carried by the support for the purpose of evacuating a flowable medium therefrom; means for tapping cooling units to permit evacuation of flowable medium from the cooling unit which is temporarily carried by said support; and means for collecting flowable medium issuing from the cooling unit which is temporarily carried by said support.

2. The apparatus of claim 1, wherein said tapping means includes means for making holes in cooling units and conduit means connecting said hole making means with said collecting means.

3. The apparatus of claim 1, wherein said collecting means is disposed beneath said support and comprises at least one vessel arranged to gather the flowable medium which issues from the tapped cooling unit on said support in at least one selected position of inclination of the support.

4. The apparatus of claim 1, further comprising means for heating cooling units on said support.

5. The apparatus of claim 4, further comprising a housing for said support and said inclination changing means.

6. Apparatus for evacuation of flowable media which are confined in cooling units, comprising a support; means for changing the inclination of said support; means for transporting cooling units onto and off said support; means for tapping cooling units to permit evacuation of flowable medium from the cooling units on said support; means for collecting flowable medium which issues from the cooling unit on said support; at which one additional support; means for changing the inclination of said at least one additional support; means for transporting cooling units onto and off said at least one additional support; means for tapping cooling units to permit evacuation of flowable medium from the cooling unit on said at least one additional support; and means for collecting flowable medium which causes from the cooling unit on said at least one additional support.

7. The apparatus of claim 6 further comprising a common conveyance for said supports, said inclination changing means, said transporting means, said tapping means and said collecting means.

8. Apparatus for evacuating flowable media which are confined in cooling units, comprising a support; means for changing the inclination of said support; means for transporting cooling units onto and off said support, said transporting means comprising a first conveyor having means for delivering cooling units onto said support and a second conveyor having means for removing cooling units from said support; means for tapping cooling units to permit evacuation of flowable medium from the cooling unit on said support; and means for collecting flowable medium which issues form the cooling unit on said support.

9. The apparatus of claim 8, wherein each of said conveyors comprises a substantially horizontal track at a level above said support, a trolley movable along the respective track, an engaging member having means for attracting cooling units by suction, and means for substantially vertically movably mounting the engaging member on the respective trolley.

10. The apparatus of claim 9, wherein the track of one of said conveyors is aligned with the track of the other of said conveyors.

11. Apparatus for evacuating flowable media which are confined in cooling units, comprising a support, said support including a platform having means for releasably holding cooling units thereon; means for changing the inclination of said support, including a carrier, at least one universal joint tiltably connecting said platform to said carrier, and means for tilting said platform with reference to said carrier; means for transporting cooling units onto and off said support; means for tapping cooling units to permit evacuation of flowable medium from the cooling unit on said support; and means for collecting flowable medium which issues from the cooling unit on said support.

12. The apparatus of claim 11, wherein said holding means comprises means for attracting cooling units to said platform by suction.

13. The apparatus of claim 11, wherein said carrier includes a column and said at least one universal joint connects said platform to said column.

14. The apparatus of claim 11, wherein said tilting means comprises at least one fluid-operated motor.

* * * * *